US005180156A

United States Patent [19]

Matsui et al.

[11] Patent Number: 5,180,156

[45] Date of Patent: Jan. 19, 1993

[54] METHOD OF FEEDING SHEETS USING A CONTROLLED SUCTION PAD MOVEMENT

[75] Inventors: Toshitaka Matsui; Nobuyuki Torisawa; Yoshiyuki Yazawa, all of Minamiashigara, Japan

[73] Assignee: Fuji Photo Film Co., Ltd., Kanagawa, Japan

[21] Appl. No.: 695,133

[22] Filed: May 3, 1991

[30] Foreign Application Priority Data

May 7, 1990 [JP] Japan ..... 2-117127

[51] Int. Cl.[5] ..... B65H 3/08

[52] U.S. Cl. ..... 271/103; 271/11; 271/104; 271/265

[58] Field of Search ..... 271/11, 90, 103, 104, 271/105, 106, 258, 260, 265, 14, 102, 270

[56] References Cited

U.S. PATENT DOCUMENTS 3,837,638 9/1974 Anderson et al. ..... 271/103 X
4,382,593 5/1983 Beran et al. ..... 271/104 X
4,518,159 5/1985 Nishibori et al. ..... 271/103
4,936,566 6/1990 Hiramatsu ..... 271/103 X

*Primary Examiner*—Joseph E. Valenza
*Assistant Examiner*—Boris Milef
*Attorney, Agent, or Firm*—Sughrue, Mion, Zinn, Macpeak & Seas

[57] ABSTRACT

Disclosed herein is a method of feeding sheets. The sheets such as photographic photosensitive films are fed one by one by a suction pad in an image recording apparatus. The suction pad is displaced at a higher speed toward a stack of sheets, and then the speed of the suction pad is reduced to cause the suction pad to approach the stacked sheets ata lower speed. It is thereafter detected whether or not an uppermost one of the stacked sheets is attracted by the suction pad. Further, the suction pad is stopped from being moved toward the stacked sheets immediately upon detecting that the suction pad has attracted the uppermost sheet, and is also displaced away from the stacked sheets until the suction pad reaches a desired position.

7 Claims, 5 Drawing Sheets

METHOD OF FEEDING SHEETS USING A CONTROLLED SUCTION PAD MOVEMENT

BACKGROUND OF THE INVENTION

1. Field of the Invention

The present invention relates to a method of feeding sheets, and more specifically to a method of feeding sheets to a desired position by making use of a vacuum suction pad.

2. Description of the Related Art

There is known a mechanism for attracting and holding the uppermost sheet of a stack of sheets by a suction pad to thereby feed the same. This type of mechanism comprises a suction pad for attracting and holding the uppermost sheet of the stacked sheets, and a suction-pad displacing mechanism for detaching or displacing the suction pad from the sheets, and a vacuum suction source for supplying vacuum to the inside of the suction pad.

More specifically, the displacing mechanism is energized to displace the suction pad from the sheets by a predetermined stroke. After the suction pad is pressed against the sheets, the vacuum suction source is energized to subject the inside of the suction pad to the vacuum, thereby attracting the uppermost sheet under such a vacuum by the suction pad and feeding the same.

However, in the above-described prior art, the suction pad is normally displaced by a certain stroke from the sheets without taking into consideration any remaining stacked sheets. Therefore, when the suction pad is pressed against the sheets, it releases air from in-between the stacked sheets. As a result, a plurality of sheets are sucked simultaneously by the suction pad, thereby malfunctioning with the succeeding sheet feeding operation in a sheet feeding apparatus.

SUMMARY OF THE INVENTION

It is a general object of the present invention to provide a method for reliably feeding a sheet one by one without feeding a plurality of sheets simultaneously to thereby achieve increased efficiency of a sheet feeding cycle.

It is a principal object of the present invention to provide a method for feeding sheets one by one, wherein an uppermost one of stacked sheets is attracted by a suction pad in a state in which the suction pad is spaced slightly away from the sheets, thereby making it possible to shorten the cycle to feed the sheet.

It is another object of the present invention to provide a method for feeding sheets on by one, comprising the following five steps of displacing a suction pad: a first step of displacing the suction pad at a high speed toward stacked sheets, a second step of reducing the speed of the suction pad so as to cause the suction pad to approach the stacked sheets at a lower speed without pressing the stacked sheets, a third step of detecting whether or not the suction pad attracts an uppermost one of the stacked sheets, a fourth step of stopping the suction pad from being moved toward the stacked sheets immediately upon detecting that the suction pad has attracted the uppermost sheet, and a fifth step of displacing the suction pad away from the stacked sheets until the suction pad reaches a desired position.

It is a further object of the present invention to provide the method further including the step of determining, subsequent to the fourth step, whether or not after a predetermined period of time elapses, the suction pad has attracted the uppermost sheet.

It is a still further object of the present invention to provide the method further including the step of determining, subsequent to the attraction-determining step, whether or not the uppermost sheet is reliably attracted to the suction pad.

It is a still further object of the present invention to provide the method further including the step of lifting, subsequent to the fourth step, the suction pad together with the uppermost sheet attracted thereto at a lower speed from a position where the displacement of the suction pad toward the sheets is stopped.

It is a still further object of the present invention to provide the method further including the step of temporarily stopping the suction pad to determine whether or not the suction pad attracts the uppermost sheet after the suction pad is separated at the low speed from the position.

It is a still further object of the present invention to provide the method wherein a vacuum suction source for the suction pad is energized after the first step is initiated.

It is a still further object of the present invention to provide the method wherein the vacuum suction source for the suction pad is energized after the second step is initiated.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

FIGS. 2*a*–3*c* are diagrams for describing the manner in which the sheet feeding method according to said one embodiment of the present invention is executed;

DETAILED DESCRIPTION OF THE PREFERRED EMBODIMENTS

Figure 1:
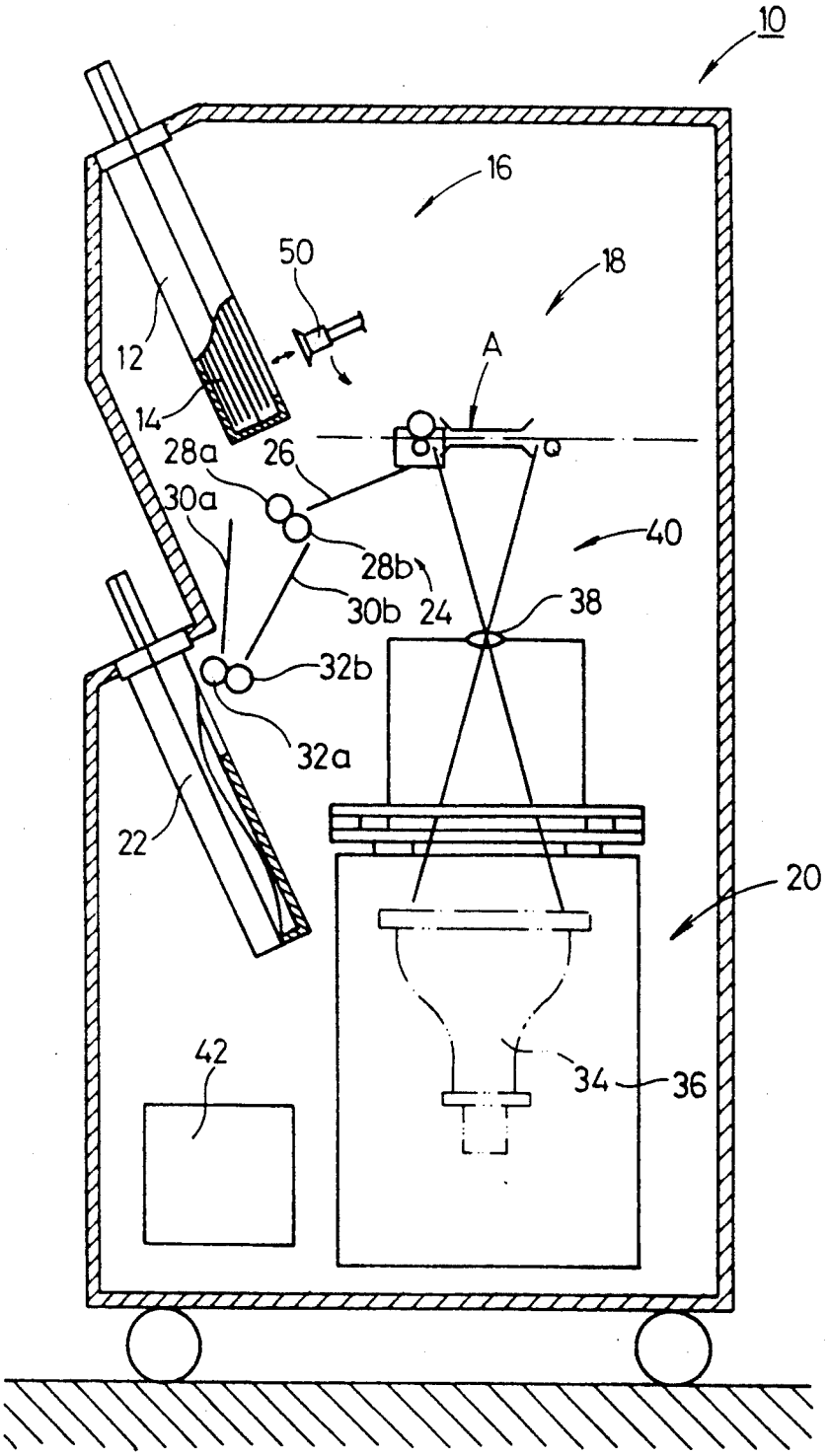
FIG. 1 is an overall diagram schematically showing an image recording apparatus for performing a method of feeding sheets according to one embodiment of the present invention.

FIG. 1 shows an image recording apparatus 10 for performing a method of feeding sheets according to one embodiment of the present invention. In the same drawing, the image recording apparatus 10 mainly comprises a sheet feeding mechanism 16 for taking out unexposed photographic photosensitive mediums 14 (hereinafter called merely "sheets") comprised of stacked sheets, which are stored in a supply magazine 12, a delivery mechanism 18 for delivering the sheet 14 taken out of the supply magazine 12 into an exposure position A, an exposure mechanism 20 disposed in an opposing relationship to the exposure position A, for exposing the sheet 14 to image information or the like, and a conveying mechanism 24 for delivering the exposed sheet 14 into a receiver magazine 22 where it is stacked.

Incidentally, a sheet conveying apparatus comprises the sheet feeding mechanism 16, the delivery mechanism 18 or the like in the present embodiment.

The conveying mechanism 24 has a guide plate 26 for guiding the exposed sheet 14 delivered by the delivery mechanism 18, a pair of guide plates 30*a*, 30*b* for guiding the sheet 14 delivered to the guide plate 26, a pair of drive rollers 28*a*, 28*b*, and a pair of drive rollers 32*a*, 32*b* for sending the sheet 14 into the receiver magazine 22 while the sheet 14 being gripped therebetween.

Then, the exposure mechanism 20 includes an image display unit 36 for displaying image information on a CRT display 34, and an optical system 40 for exposing the sheet 14 to the image information displayed on the CRT display 34 through a focusing lens 38.

Incidentally, the image display unit 36 and the optical system 40 are vertically movable in FIG. 1, so that they are moved into a most suitable position where the sheet 14 can be exposed to desired image information upon exposure.

The sheet feeding mechanism 16, the delivery mechanism 18, the conveying mechanism 24, and the exposure mechanism 20 in the image recording apparatus 10 have respective electric circuits which are controlled by a controller 42 mainly including a microcomputer disposed in the casing of the image recording apparatus 10.

Then, the sheet feeding method according to the present invention, which is executed in the image recording apparatus 10 constructed as described above, will hereinafter be described in detail.

Figure 2:
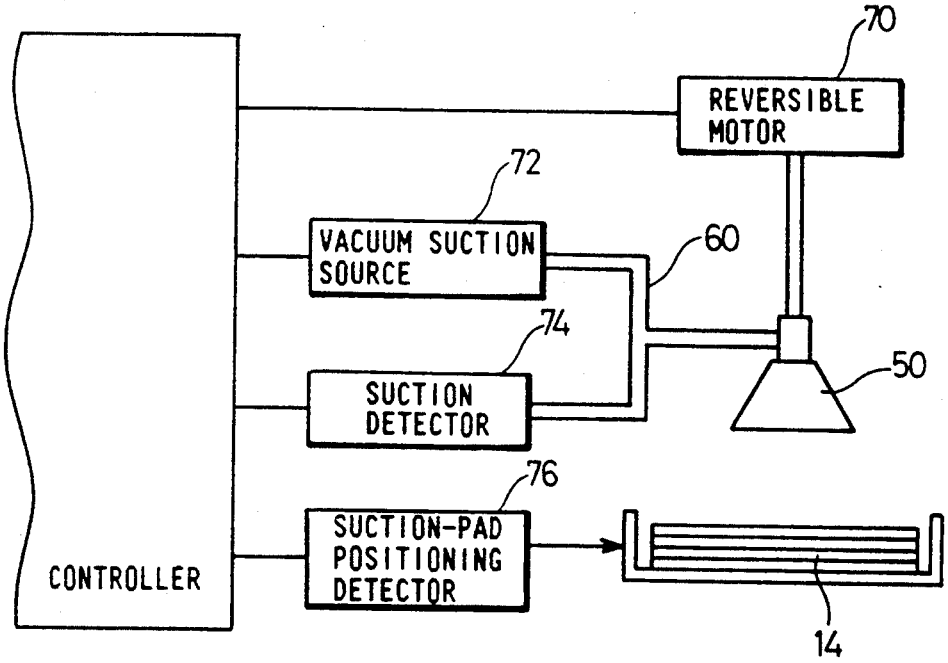
FIG. 2 is a diagram illustrating a overall structure of the sheet feeding method according to said one embodiment of the present invention.
Figure 3C:
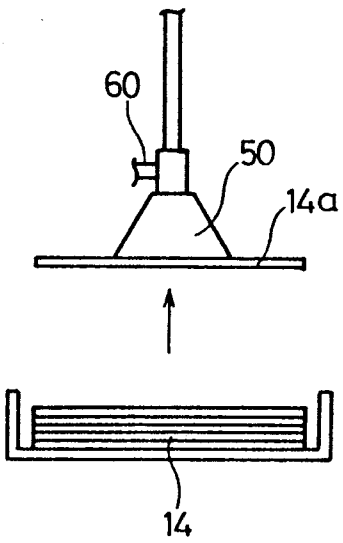
Figure 3B:
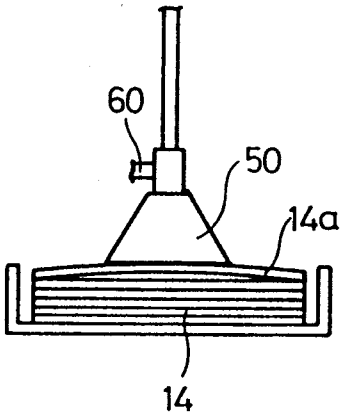
Figure 3A:
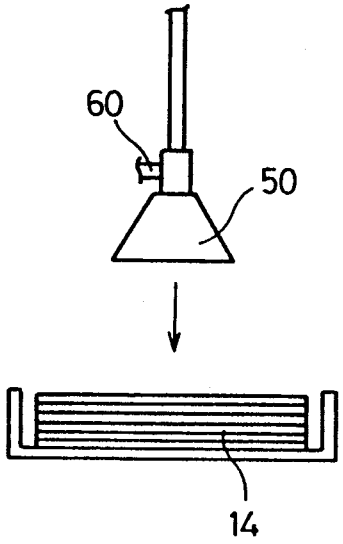
Figure 4:
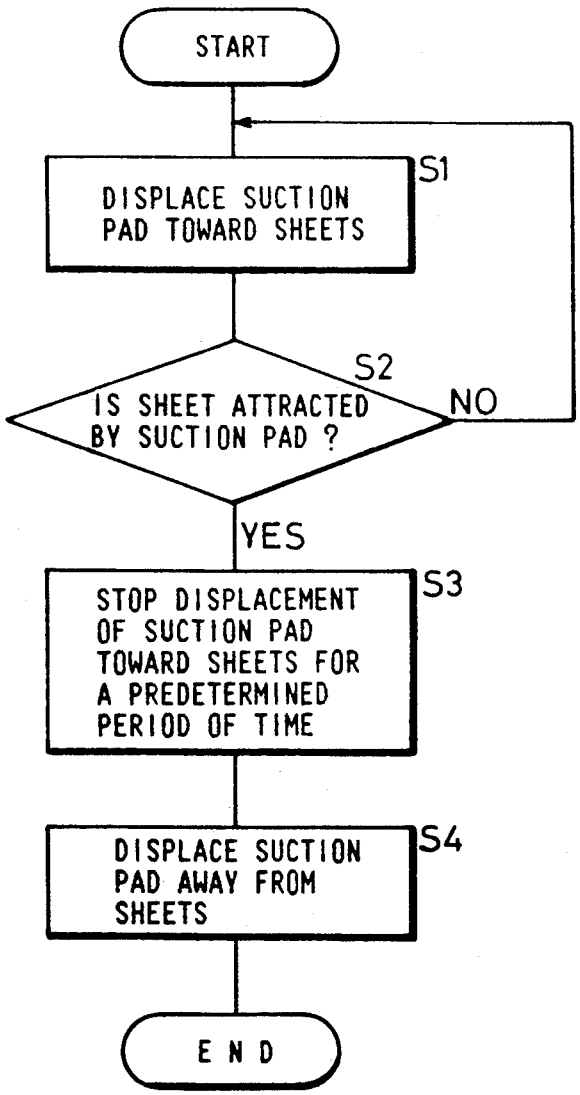
FIG. 4 is a flowchart for describing the routine procedure according to the sheet feeding method of the present invention.

As shown in FIGS. 2 through 4, a reversible motor 70 of a rotative drive source is first actuated to displace a suction pad 50 toward the sheets 14 at a high speed (see FIG. 3*a* and Step S1 in FIG. 4). In this case, the suction pad 50 is displaced toward the sheets 14 at a high speed of 24.1 mm/sec., for example. Then, a vacuum suction source 72 is energized. Thus, the suction pad 50 is caused to approach the sheets 14, and subjected to a lower speed, for example—1.7 mm/sec. at a certain position. The suction pad 50 approaches the uppermost sheet in the supply magazine 12 at the lower speed. When the distance between the uppermost sheet 14 and the suction pad 50 becomes short, the suction pad 50 is subjected in its inside to an increased vacuum, thereby attracting and holding the uppermost sheet 14. When a suction detector 74 detects that the suction pad 50 has attracted and held the sheet 14, the displacement of the suction pad 50 toward the sheet 14 is stopped immediately (see FIG. 3*a* and Step S2 in FIG. 4). After the displacement of the suction pad 50 toward the sheet 14 is stopped for a predetermined period of time (200 msec. for example), it is determined or confirmed whether or not the sheet 14 is attracted and held by the suction pad 50 (Step S3 in FIG. 4). If it is judged to be positive, the suction pad 50 is displaced away from a stack of other sheets 14 until it reaches a predetermined position (see FIG. 3*c* and Step S4 in FIG. 4). As an alternative, the suction pad 50 may be displaced slightly upwardly of its stop position at a low speed (on the order of 1 to 3 mm, for example) so that it is temporarily stopped at its upwardly-displaced position (for 2 seconds or less, for example). The confirmation as to whether the sheet 14 is attracted and held by the suction pad 50 may be carried out by detecting an increase in the vacuum at the inside of the suction pad 50 with the suction detector 74 (for example, a pressure sensor using a piezo-type semiconductor sensor) or the like attached to a tube 60 coupled directly to the suction pad 50, and then applying the result of its detection to the motor 70 as an electric signal. According to the present embodiment, as described in the above-described operation, the suction pad 50 can attract and hold only the uppermost sheet 14*a* without being pressed against the sheet 14. Thereafter, the suction pad 50 is displaced upwardly at a high speed until it reaches a predetermined height.

Another embodiment of the present invention will now be described with reference to FIGS. 5*a* through 5*d*.

Figure 5A:
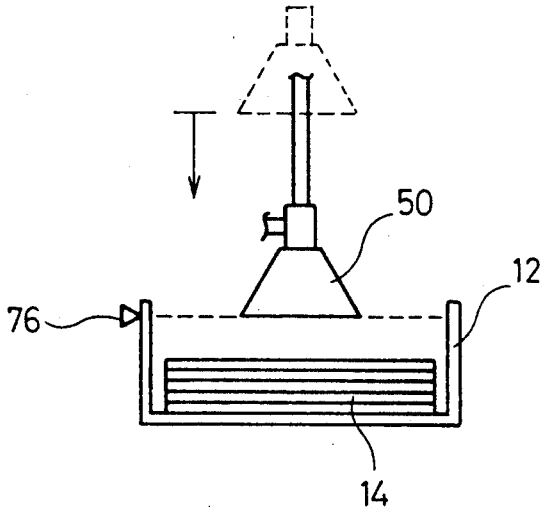
FIGS. 5*a*–5*d* are diagrams for describing the manner in which a method of feeding sheets according to another embodiment of the present invention is executed.
Figure 5B:
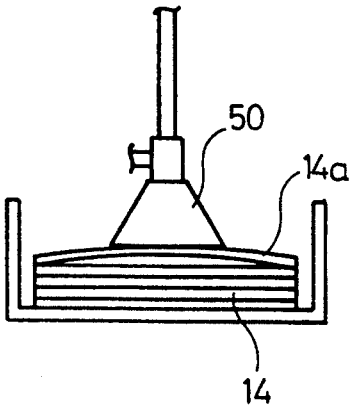
Figure 5C:
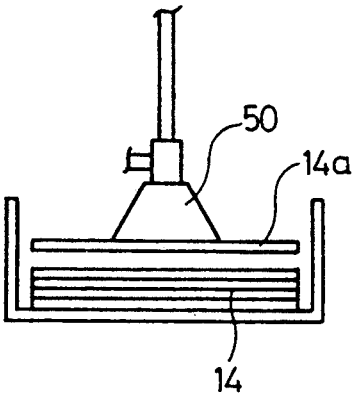
Figure 5D:
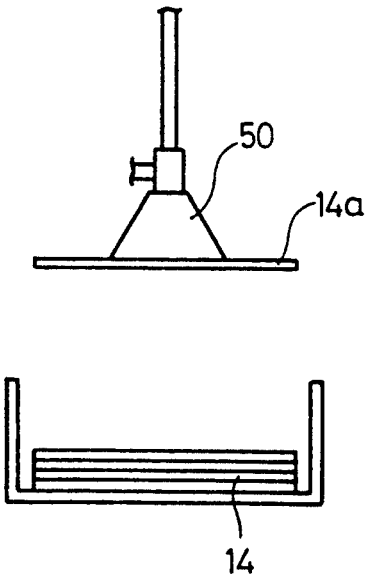

As shown in FIG. 5*a*, when the position of a suction pad 50 being displaced at a high speed with respect to stacked sheets 14 is detected by a suction-pad positioning detector 76 (for example, photosensor) disposed in a desired position of a supply magazine 12, the rotational speed of the motor 70 is controlled based on the result of its detection as an electric signal. As a consequence, the speed of the suction pad 50 is reduced and a vacuum suction source 72 is actuated. When it is then confirmed by a suction detector 74 whether or not the sheet 14 is attracted and held by the suction pad 50, the displacement of the suction pad 50 toward the sheets 14 is stopped immediately as shown in FIG. 5*b*, and thereafter the motor 70 is energized to turn in the opposite direction, so that the suction pad 50 is stopped in a desired position as shown in FIG. 5*c*. After the suction pad 50 has been stopped there for a predetermined period of time, it is judged that the sheet 14*a* has reliably been attracted and held by the suction pad 50 and the suction pad 50 is lifted upwardly at a higher speed until it reaches a certain position as shown in FIG. 5*d*.

With the present embodiment, the suction pad 50 can attract and hold the sheet 14 without being directly pressed against the sheet 14. Thus, the stacked sheets can reliably be fed one by one by the suction pad without-feeding a plurality of sheets together at the same time.

According to the present invention, as has been described above, the suction pad can be displaced toward the sheets at a high speed for a predetermined period of time, and hence the cycle to feed a sheet can be shortened.

Since the speed for displaying the suction pad is reduced in the vicinity of the sheets, the suction pad is not pressed against the stacked sheets, and such thin film sheets can reliably be fed one by one by the suction pad.

Having now fully described the invention, it will be apparent to those skilled in the art that many changes and modifications can be made without departing from the spirit or scope of the invention as set forth herein.

What is claimed is:

1. A method of feeding sheets one by one, comprising the following five steps of:

a first step of displacing a suction pad at a first speed towards stacked sheets;

a second step of reducing the speed of said suction pad to a second speed so as to cause said suction pad to approach said stacked sheets at said second speed without pressing the stacked sheets;

a third step of detecting while moving at said second speed whether or not said suction pad attracts an uppermost sheet of said stacked sheets;

a fourth step of stopping said suction pad from being moved toward said stacked sheets immediately upon detecting that said suction pad has attracted said uppermost sheet; and a fifth step of displacing said suction pad away from said stacked sheets until said suction pad reaches a desired position.

2. A method according to claim 1, further including the step of:

determining, subsequent to said fourth step, whether or not said suction pad attracts said uppermost sheet after a predetermined period of time elapses.

3. A method according to claim 2, further including the step of:

determining, subsequent to said attraction-determining step, whether or not said uppermost sheet is reliably attracted to said suction pad.

4. A method according to claim 1, further including the step of:

lifting subsequent to said fourth step, said suction pad together with said uppermost sheet attracted thereto at a third speed from a position where the displacement of said suction pad toward said sheets is stopped.

5. A method according to Claim 4, further including the step of:

temporarily stopping said suction pad to determine whether or not said suction pad attracts said uppermost sheet after said suction pad is lifted at the third speed from said stopped position.

6. A method according to any one of claims 1 to 5, wherein a vacuum suction source for said suction pad is energized after said first step is initiated.

7. A method according to any one of claims 1 to 5, wherein said vacuum suction source for said suction pad is energized after said second step is initiated.

* * * * *